United States Patent [19]

Poole et al.

[11] 4,387,806

[45] Jun. 14, 1983

[54] GEM STORAGE, DISPLAY AND INVENTORY CONTROL SYSTEM

[76] Inventors: Michael M. Poole, 19565 Applebrook Creek, Strongsville, Ohio 44315; Samuel G. Solitt, 2121 Brookshire Rd., Akron, Ohio 44313; Jerry Shaw, 50 W. Fairlawn Blvd., Akron, Ohio 44313

[21] Appl. No.: 273,623

[22] Filed: Jun. 15, 1981

[51] Int. Cl.[3] ..... B65D 51/24

[52] U.S. Cl. ..... 206/232; 206/45.13; 206/45.15; 206/45.28; 206/566

[58] Field of Search ..... 206/232, 44.11, 45.13, 206/45.15, 45.28, 425, 566, 0.81, 214, 371; 190/16; 217/62, 9, 10, 63, 11; 63/30; 229/92.8; 220/23, 345; 269/11, 16, 289 R, 901

[56] References Cited

U.S. PATENT DOCUMENTS

| | | | |
|---|---|---|---|
| 2,607 | 0/1868 | Knewstub | 217/7 |
| 752,463 | 2/1904 | Morris | 217/5 |
| 772,326 | 10/1904 | Allin | 220/345 |
| 1,973,283 | 9/1934 | Buttrick | 190/16 |
| 2,874,828 | 2/1959 | Neugebauer | 206/45.15 |
| 3,159,329 | 12/1964 | Hiersteiner | 206/0.81 |
| 3,755,925 | 9/1973 | Court | 206/232 X |
| 4,176,743 | 12/1979 | Fitzpatrick | 206/214 |
| 4,324,446 | 4/1982 | Le Sage | 206/566 X |

FOREIGN PATENT DOCUMENTS

| | | | |
|---|---|---|---|
| 288669 | 11/1915 | Fed. Rep. of Germany | 206/0.81 |
| 7810979 | 11/1979 | France | 229/92.8 |

*Primary Examiner*—William T. Dixson, Jr.
*Assistant Examiner*—Brenda J. Ehrhardt
*Attorney, Agent, or Firm*—Reese Taylor

[57] ABSTRACT

A gem storage, display and inventory control system includes a storage container, a display unit, and a control package. The control package is a multi-part, folding, card type unit which includes two sheets joined by a perforated seam and a third, loose, sheet. The outer face of the first sheet contains indicia and space for describing the gem and a an aperture in which the gem itself can be received. The reverse side of the first sheet contains the customer's name, address, etc., and various sales data. The second sheet of the multi-part combination contains, on its inner surface, information comparable to that on the front of the first sheet and its reverse is essentially a postage reply card which can be used for reordering the particular gem. The third part of the control package is a loose index card which can be retained in the storage container until the inventory is replenished. The control package is receivable within a box-like storage container for inventory control and storage purposes. The display unit of the system consists of a foldable pad which is divided into three substantially equal sized sections interconnected by hinges. This pad also contains various display components and utensils as well as a magnifying glass, and is capable of being folded and slid into the top of the storage container when not in use. In this fashion, the three main components make up an integrated storage, display and inventory control system.

4 Claims, 9 Drawing Figures

GEM STORAGE, DISPLAY AND INVENTORY CONTROL SYSTEM

FIELD OF THE INVENTION

This invention, in general, relates to the field of jewelry storage, customer display, and inventory control and in particular relates to such a system for storage, display, and inventory control primarily related to the sale of precious stones or gems.

DESCRIPTION OF THE PRIOR ART

Among other things, jewelers who sell precious stones such as diamonds, are confronted with three basic problems the solution of which become the general objects of this invention.

First, it is necessary to have the precious stones stored in a safe plate but also in a place which is readily accessible so that the appropriate stone for the appropriate customer can readily and quickly be retrieved from storage for showing to the customer.

Second, it is always desirable to present and display the stone to the customer in the most attractive and efficient manner possible so as to enhance the possibilities of sale.

Third, it is necessary and desirable to maintain close control over inventory so that the inventory can continuously be replenished. Somewhat related to this object is the desirability of maintaining records as to which type, grade, etc., stone was sold to what customer on a given date, so as to maintain follow up records for customer service and subsequent sales.

While there are various ways of accomplishing all of the above noted objectives, Applicant is unaware of any single integrated system which can easily, compactly, economically, and efficiently accomplish them.

SUMMARY OF THE INVENTION

It has been found that the aforenoted objectives can all be accomplished by provision of a relatively simple, integrated, three component system.

The first objective is to provide well organized storage and it has been found that that can be accomplished by the provision of a storage container which is essentially a box-like unit having a normally open top. The gems and the necessary packets, filing data, etc., can all be readily retained in this box.

The second objective is to provide an attractive and efficient display unit. It has been discovered that this can be achieved by providing a foldable pad which is divided into three substantially identical sized sections and which is foldable so as to slide into the top of the storage container when not in use with the customer. It has also been discovered that the effectiveness of this display unit can be enhanced by providing it with receptacles for holding the gems when they are being shown to the customer; magnifying means so that improved visual access to the gems can be achieved; and means for displaying data cards related to the particular gem.

The third objective is to provide inventory control and it has been found that this can be achieved by providing a control package which not only is capable of storing the gem but is capable of imparting information to the customer, serving as a reorder form and receiving information regarding the sale to the customer. It has also been found, of course, that this control package can be received within the storage container, as is the display unit, so that the entire system is contained in one compact integrated system.

Accordingly, production of an improved gem storage, display and inventory control system of the character above described becomes the principal object of this invention with other objects thereof becoming more apparent upon a reading of the following brief specification considered and interpreted in view of the accompanying drawings.

OF THE DRAWINGS

BRIEF DESCRIPTION OF THE PREFERRED EMBODIMENTS

Figure 1:
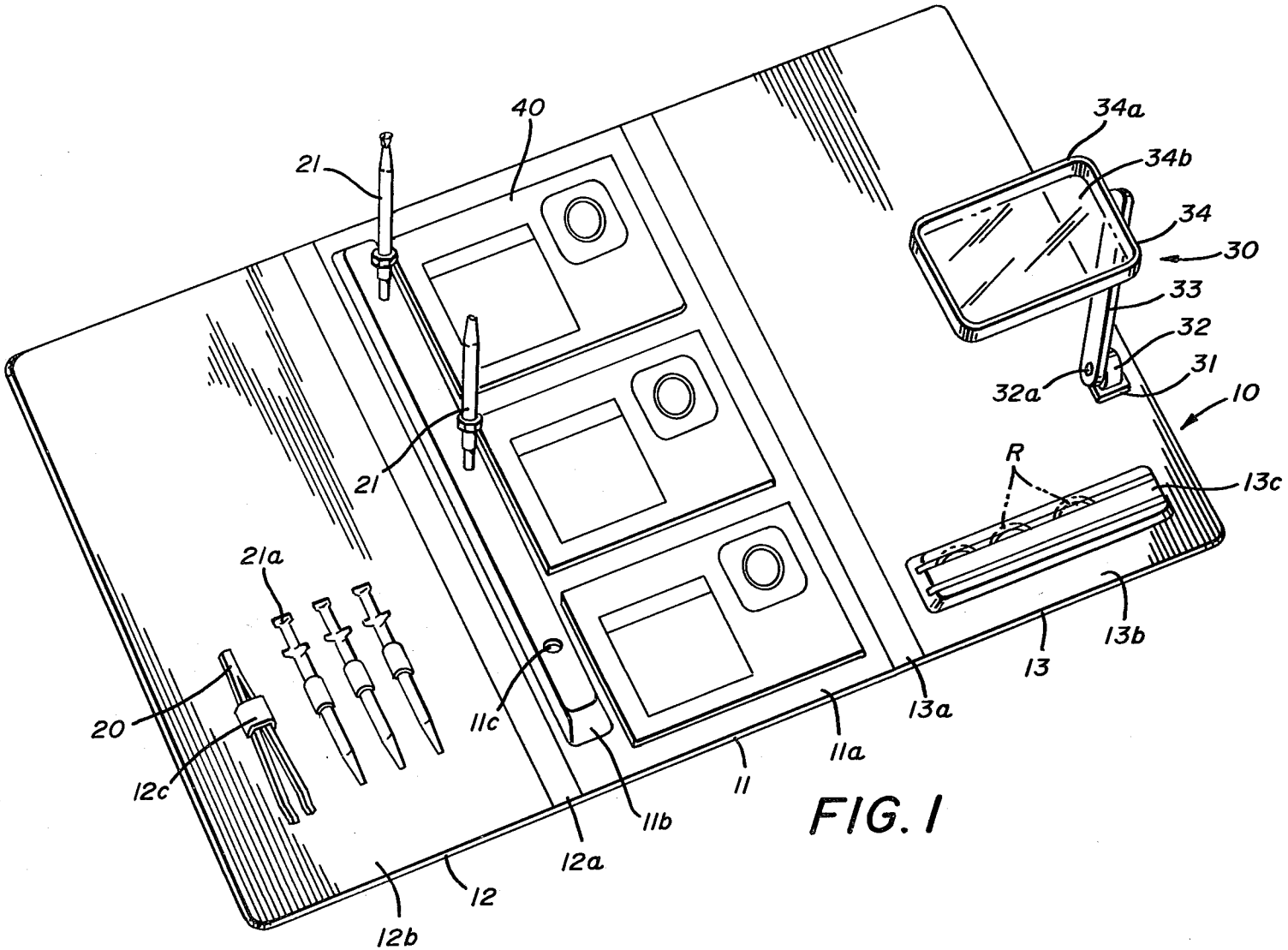
FIG. 1 is a perspective view of the improved display unit in its operative position.
Figure 2:
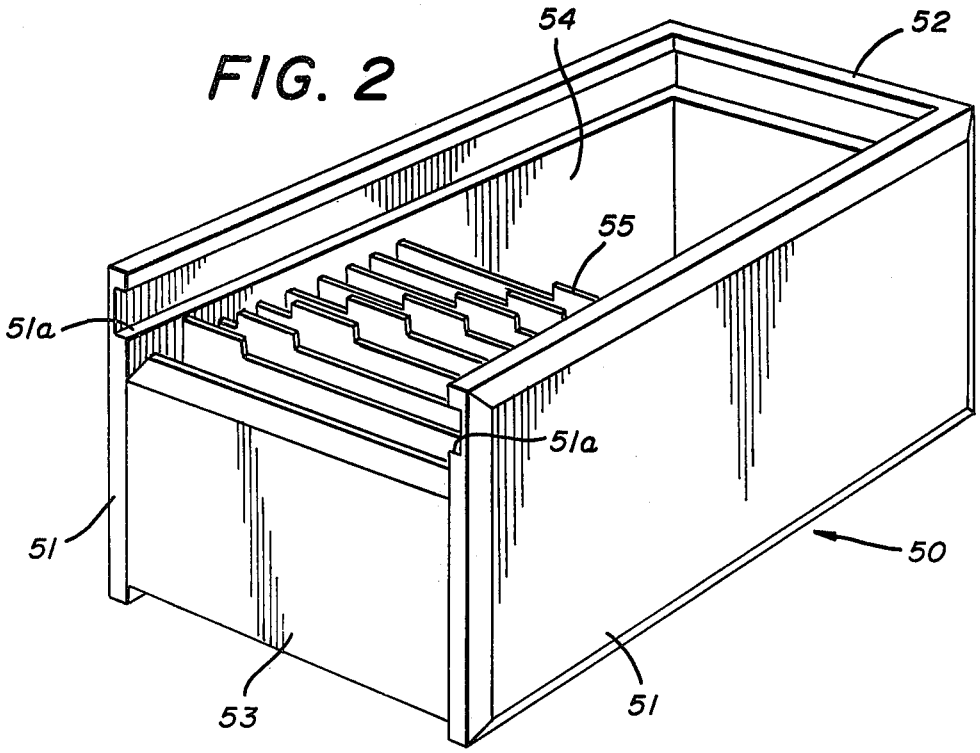
FIG. 2 is a perspective view of the improved storage container with the top open.
Figure 7:
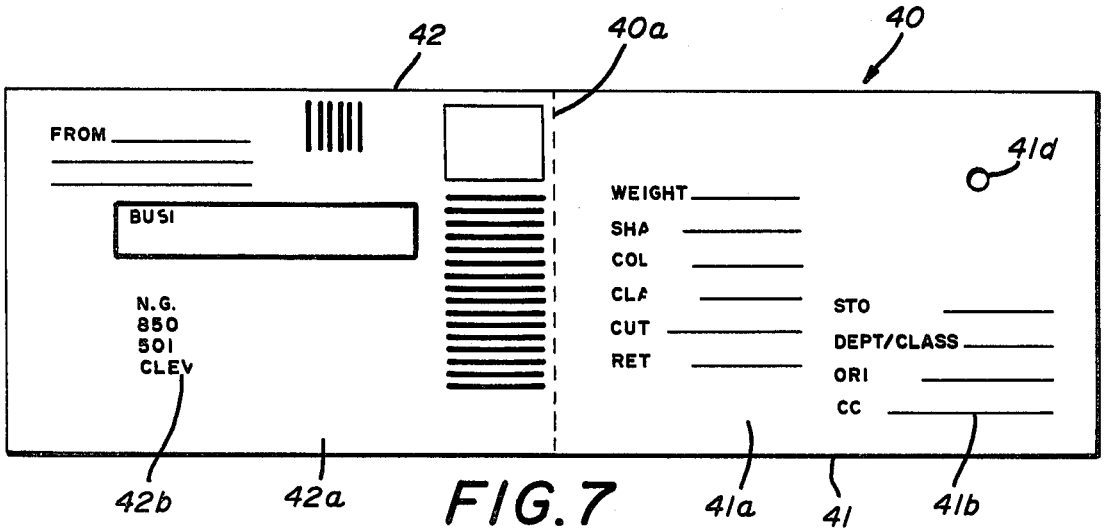
FIG. 7 is a plan view of the outer surfaces of the first and second cards of the control package.

Referring first to FIGS. 1, 2, and 7 of the drawings, it will be noted that the main components of the gem storage, display and inventory control system are a display unit 10, a control package 40, and a storage unit 50.

Referring to FIG. 1 for a brief description of the display unit 10, it will be noted that this essentially is a foldable pad generally indicated by the numeral 10. The pad is divided into three sections 11, 12, and 13 which are essentially identical in size and which are interconnected by hinged portions **12*a* and 13*a*. Furthermore, the surface of each of the sections is covered with felt or similar soft material for decorative and display purposes as indicated by the numerals 11*a*, 12*b*, and 13*b***.

The center section 11 of display unit 10 also includes an elongate support mechanism **11*b* which will be described more fully below, and which is designed to receive portions of the control package 40** as well as means for holding the gems.

The section 12 of display unit 10 has a series of loops **12*c* formed in its top surface that are intended to receive various utensils such as the tweezers 20 and the gem supporting units 21** for storage.

The section 13 of display unit 10 includes a ring support unit **13*c* and a magnifying unit 34**.

The magnifying unit 34 consists of an attachment plate 31 which is secured to the top surface of section 13 by any suitable means, a pivot support 32, and an elongate arm 33. Attached to the opposed end of the elongate arm 33 is the magnifying means which includes a frame **34*a* and a magnifying glass 34*b*. This entire unit is collapsible and is capable of being moved from the upright position illustrated in FIG. 1 to a flat position on the surface 13*b*. In this regard, arm 33 pivots about pivot 32***a* and frame 34*a* pivots about its point of attachment to the end of arm 33.

Figure 3:
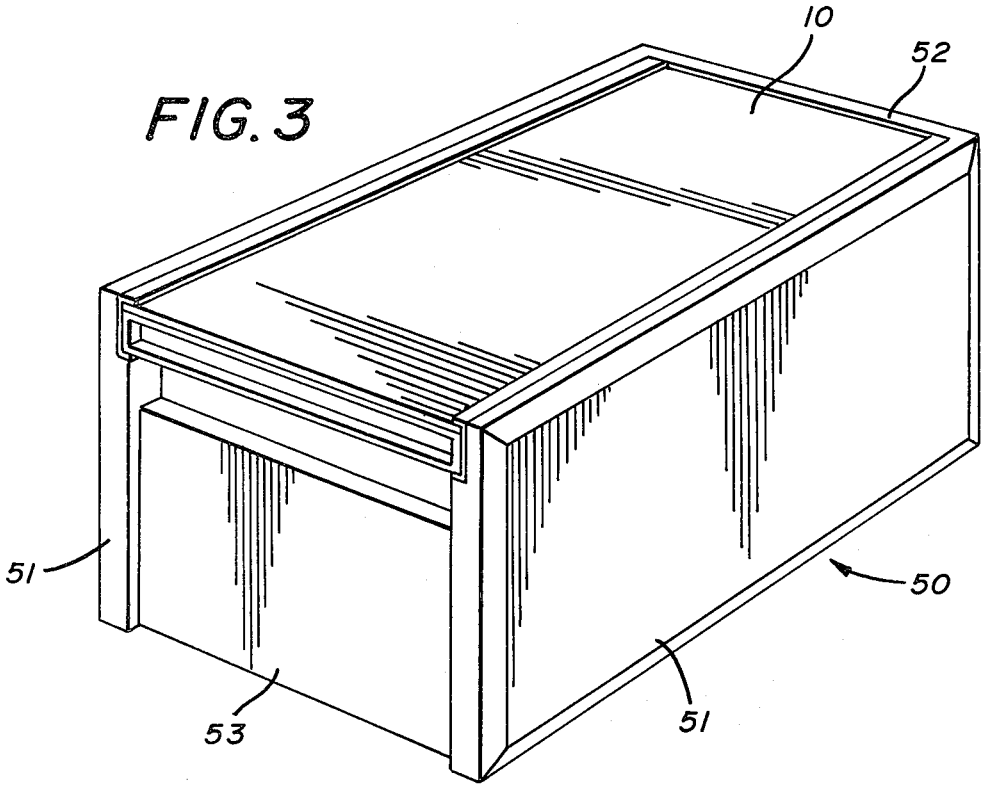
FIG. 3 is a perspective view of the improved storage container showing the display unit in place to close the top of the storage container.

The entire unit 10 is capable of being folded about hinge portions 12*a*, 13*a* and slid into the top of the storage container 50 as illustrated in FIG. 3 of the drawings.

Referring next then to FIGS. 2 and 3, it will be seen that the storage container 50 is a generally box-like unit comprising opposed side walls 51,51 and opposed end walls 52,52. Channel rails 51*a*,51*a* are provided adjacent the top edges of the side walls 51,51 and the folded display unit 10 can be slid into in these rails as illustrated in FIG. 3 of the drawings. Thus, when not in use, display unit 10 serves to close off the top of storage container 50.

Furthermore, the control and display packages 40, which will now be described, can also be received within the interior 54 of the storage container 50, and can be appropriately indexed by means of the locator cards 55.

Figure 8:
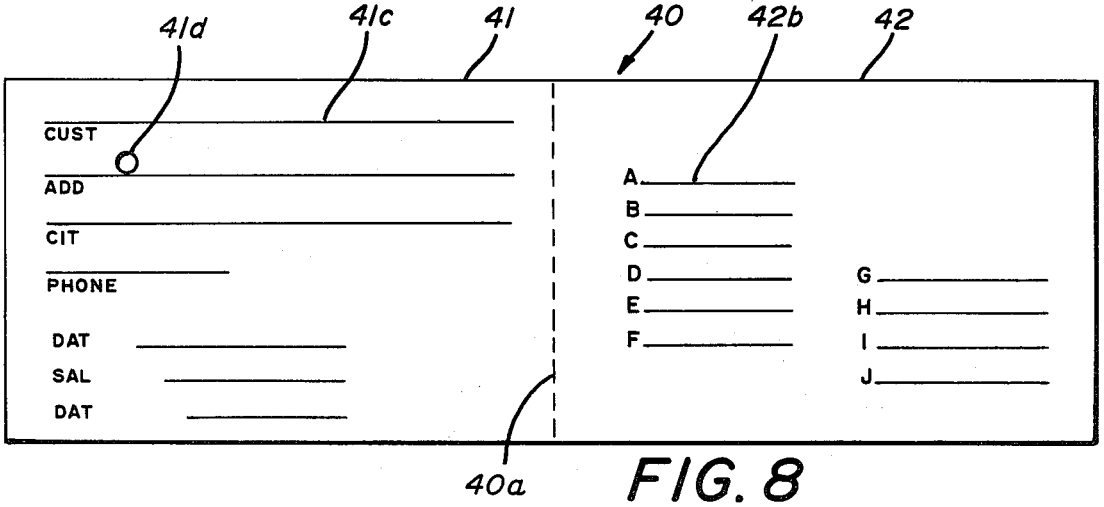
FIG. 8 is a view similar to FIG. 7 showing the reverse sides of the first and second cards.
Figure 9:
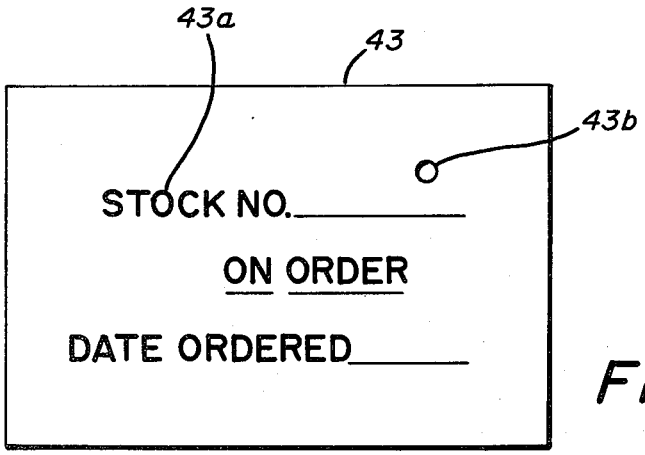
FIG. 9 is a plan view of the third card of the control package.

Referring then to FIGS. 7, 8, and 9 of the drawings for a description of the control packages, it will be noted that the control package 40 includes a fold open two-part card type unit. FIG. 7 illustrates the outer surfaces of the first two cards while FIG. 8 illustrates the reverse surfaces thereof. The first or front card 41 has indicia 41*b* on its outer face 41*a* which are intended to record details of the particular gem involved. Card 41 also has an aperture 41*d* which is capable of receiving that gem.

The reverse side of the front card 41 (see FIG. 8) contains indicia and space 41*c* for recording information regarding the purchaser of that particular gem.

The second or rear card 42 has an outer face 42*a* which generally is, in fact, a postage reply card bearing mailing information 42*b* so that it can be mailed to the supplier when that particular stone is sold. To that end, the inside surface of the card 42 contains information 42*b* identical to that on the front side of card 41 so that it is a simple matter to replenish the inventory and keep it current once the particular stone is sold.

Cards 41 and 42 are also joined by a perforated hinge 40*a* for easy separation.

As noted, the control package 40 also contains a third member, namely the card 43, illustrated in FIG. 9. That card is normally kept with the cards 41 and 42 (see FIGS. 5 and 6) and is simply inserted into the storage container 50 at the appropriate place when the reorder process takes place so that the jeweler is aware of the fact that he has reordered that particular item. Finally, the entire control package 40 may, if desired, be kept in a clear plastic or other type envelope.

In utilizing the system just described, it will first be assumed that the customer will enter the store and request a diamond or other gem having certain characteristics such as size, price, quality, etc. The jeweler will then remove display unit 10 and refer to the storage container 50 and extract one or more control packages 40 containing gems of the general description desired by the customer.

He will then also open the display unit 10 to the condition of FIG. 1 of the drawings placing the appropriate cards from the control package on the surface 11*a* of the center section 11 with surface 41*a* exposed. The gem may then be removed from the aperture 41*b* of card 41 by the tweezers 20 and inserted into the grasping means 21*e* of the holder 21 (see FIG. 5). The holder 21 includes a first shank 21*a* having an enlarged head 21*b* and a second shank 21*c* telescoped over shank 21*a* and spring loaded. By depressing shank 21*c* in the direction of arrow 21*d* the expandable grasping means 21*e* will open to receive gem G. The detailed structure of holder 21 has not been illustrated in detail since it is, per se, not novel.

The holder 21 may then be inserted into the support means 11*b* so that the prospective customer may then view it quite clearly. In the form of the invention illustrated in FIG. 1 of the drawings, this is accomplished by slipping the enlarged head 21*b* into the appropriate opening in support means 11*b*. The card 41 will convey all of the necessary information to the customer. If desired, the holders 21 can be taken out of the support rack 11*b* and held beneath the magnifying means 30 so that the gem can be examined in greater detail. It is also possible to examine ring settings R by removing them from the support rack 13*c* and again they can also be subject to magnification by the magnifying means 30.

If the customer purchases a specific gem, the sale information can be recorded on the reverse side 41*c* of the card 41 with that card then being stored elsewhere. The card 42 may then be used for reordering and the card 43 can be returned to the storage container 50 in the appropriate place until the reorder is completed. Of course, if the customer decides not to purchase a specific gem, the entire control package 40 can be returned to the container 50.

Figure 5:
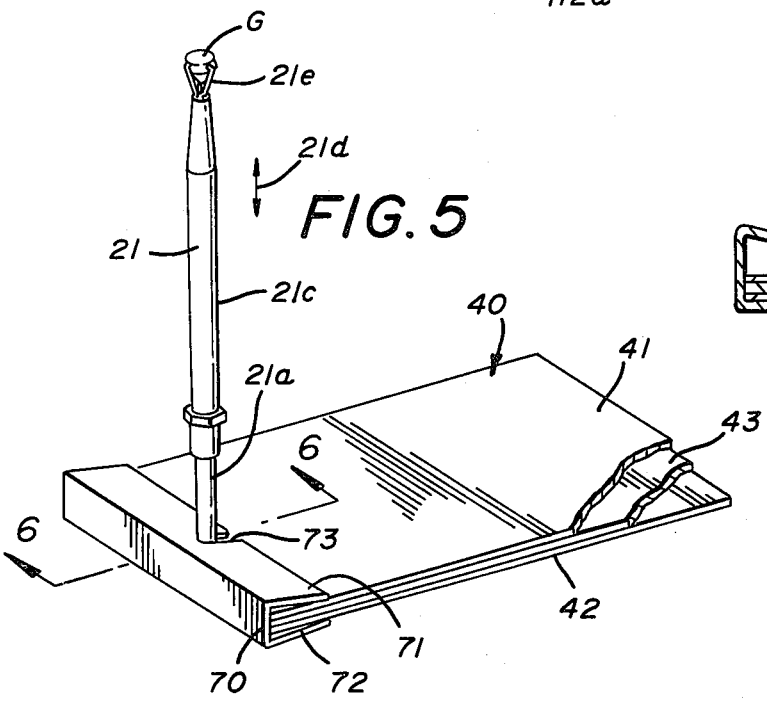
FIG. 5 is a perspective view partially broken away showing one use of the control package.
Figure 6:
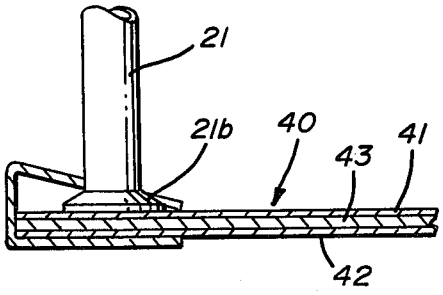
FIG. 6 is a sectional view taken along the line 6—6 of FIG. 5.

Referring to FIG. 5, a modification of the invention is disclosed. FIG. 5 illustrates the control package 40 displayed separate and apart from the display unit 10. In that instance, a retainer 70 is employed which is essentially a spring loaded clip having opposed legs 71,72 which can be clamped together about the edge of card 41. In that way, the essential information can be displayed to the prospective customer and the gem holder 21 can also be employed by slipping its enlarged head 21*b* into notch 73.

It also ought to be noted here that the clip 70 could be, if desired, substituted for the support rack 11*b* illustrated in FIG. 1.

Figure 4:
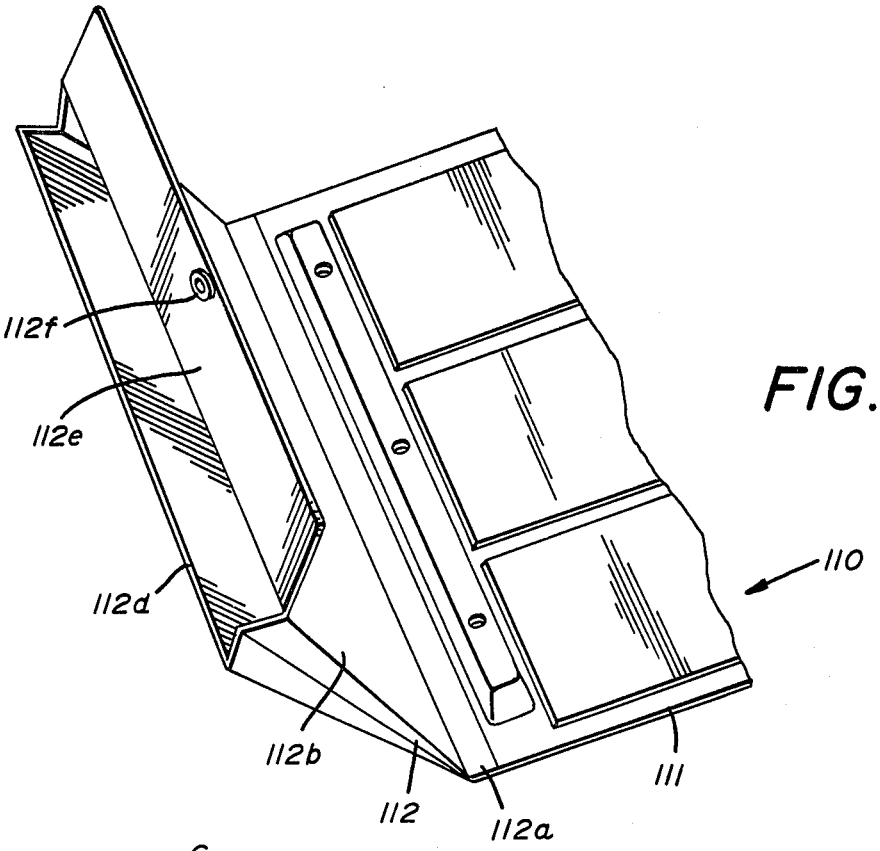
FIG. 4 is a partial perspective view of a modified form of the display unit.

FIG. 4 illustrates another modification in which similar parts have been given similar numbers in the 100 series. In this instance, the display unit 110 is identical except for the section 112. That section is essentially the same as the section 12 in FIG. 1 except that an accordian type pocket 112*d* is provided on the outer face of the section 112. A flap 112*e* is provided with a snap 112*f* and it is contemplated that the jeweler's customary guarantee, order form, or any other documents which might be desirable or useful can be stored in this pocket so as to be readily available and accessible to the jeweler when he is dealing with the customer.

While a full and complete description of the invention has been set forth in accordance with the dictates of the Patent Statutes it should be understood that modifications can be resorted to without departing from the spirit hereof or the scope of the appended claims.

What is claimed is:

1. An inventory control and display system, comprising:

(A) an inventory control card having
  (1) information imparting data on one surface and
  (2) means for releasably holding a gem;
(B) a gem display implement; and
(C) a support rack for releasably holding said inventory control card and said gem display implement.

2. An inventory control package for gems, comprising:

(A) first and second of temporarily interconnected cards;

(B) one face of said first card bearing gem information and the reverse face thereof bearing customer information;

(C) one face of said second card bearing gem information and the reverse face bearing mailing information; and (D) said first card including means for releasably retaining a gem.

3. The inventory control package of claim 2 wherein a third card bearing inventory control information is provided.

4. A gem storage, display, and inventory control system, comprising:

(A) a storage container;

(B) a display unit;

(C) a control package;

(D) said display unit and said control package being normally removably received in said storage container;

(E) said control package including a pair of temporarily interconnected cards bearing indicia related to a particular gem; and (F) one of said cards containing means for releasably holding a gem.

* * * * *